US005462490A

United States Patent [19]

Donwen

[11] Patent Number: 5,462,490

[45] Date of Patent: Oct. 31, 1995

[54] BILLIARD CUE WITH IMPROVED TIP CONFIGURATION

[76] Inventor: Roger P. Donwen, 8752 Douglas Cir., Helena, Mont. 59601

[21] Appl. No.: 349,326

[22] Filed: Dec. 5, 1994

[51] Int. Cl.[6] ..... A63D 15/12

[52] U.S. Cl. ..... 473/49

[58] Field of Search ..... 473/44, 49, 51

[56] References Cited

U.S. PATENT DOCUMENTS

| | | | |
|---|---|---|---|
| 1,532,985 | 4/1925 | Bradley | 473/49 |
| 1,558,740 | 10/1925 | Mallory | 473/49 |
| 1,620,545 | 3/1927 | Grenier | 473/49 |
| 2,212,780 | 8/1940 | Koch | 473/49 |
| 2,544,970 | 3/1951 | Watson | 473/49 |
| 3,580,576 | 5/1971 | Merola | 473/49 |
| 3,598,409 | 8/1971 | Nemecek | 473/49 |

FOREIGN PATENT DOCUMENTS

| | | | |
|---|---|---|---|
| 554026 | 1/1950 | Belgium . | |
| 21021 | 12/1894 | United Kingdom | 473/49 |
| 6442 | 12/1899 | United Kingdom | 473/49 |

*Primary Examiner*—Theatrice Brown
*Attorney, Agent, or Firm*—Harry M. Cross, Jr.

[57] ABSTRACT

A billiard cue 10 comprises a handle section 12 and a cue tip section 14. This cue tip assembly comprises a ferrule 30, a cue tip insert 40 and a cue tip pad 50. The ferrule 30 and the tip 18 of the billiard cue are cooperatively constructed so that the ferrule 30 fits over and around the outer-most part 20 of the cue tip 18 and seats on an annular land 22 at the base of part 20. The cue tip insert 40 and the ferrule 30 are cooperatively constructed so that insert 40 can be releasably joined to ferrule 30. In this combination of the cue tip assembly 14 and the billiard cue shaft 13, a variety of cue tip pads can be alternately attached to the same shaft 13 (each unique in diameter and/or hardness so as to reduce or enhance cue ball deflection) simply by substituting one insert 40 for another.

6 Claims, 2 Drawing Sheets

BILLIARD CUE WITH IMPROVED TIP CONFIGURATION

BACKGROUND OF THE INVENTION

1. Field of the Invention

This invention relates to billiard cues and, more particularly, to billiard cues having a tip configuration that permits quick and convenient changing of cue tips.

2. Brief Description of the Prior Art

A conventional billiard cue comprises a wooden shaft that tapers to a tip providing a circular end surface to which a leather cue tip pad is attached. Billiard cues exist in a variety of lengths, diameters, cue tip end surface sizes, and the like to suit different billiard games and players and billiard techniques.

Billiards, whether pertaining to games involving pocket or pocketless tables, requires precision in aligning and striking the cue ball, with the application of varying degrees of "english" often required; "english" being defined as the spinning motion imparted to the cue ball as the result of the force with which the billiard cue strikes the cue ball and the direction and location of that force relative to the center of the cue ball. Consequently, some billiard cues are fabricated to have relatively larger or smaller diameter cue tip surfaces so that cue tip pads of different diameters may be used.

Replacing or substituting one cue tip pad for another, on a particular billiard cue is often required, either due to the wearing-out or damage to the cue tip pad. However, because the conventional cue tip pad is glued or cemented to the billiard cue tip circular surface, cue tip pad replacement is neither a quick nor a convenient process. In the case of competitive billiards, a time limit is often imposed within which a billiard shot must be made. The replacement of a cue tip pad in competition, therefore, is not done except in the direst of circumstances. Heretofore, one would have to change the cue shaft entirely or substitute another cue in order to obtain a cue tip replacement or substitution. However, it would be desirable on occasion, even in competitive billiards, to change from one cue tip pad to another if there were some quick and convenient way to do it. Heretofore, such has not been the case.

SUMMARY OF THE INVENTION

It is a primary object of this invention to provide a billiard cue with a cue tip configuration that enables the quick and convenient replacement or changing of cue tip pads. It is another object to provide a billiard cue tip combination having a variety of cue tip inserts fitted with cue tip pads having varying diameters and/or hardness (each pad being unique in diameter and/or hardness so as to reduce or enhance cue ball deflection) simply by substituting one insert for another so that a single billiard cue could be fitted with any number of cue tip pads in a quick and convenient manner.

In this connection, the invention comprises a billiard cue shaft tip assembly for attachment to a shaft that has an tip end provided with an elongated axial tenon. The tip assembly comprises a ferrule adapted to be secured to the shaft tip end tenon, a tip insert having an elongated axial tenon adapted to be releasably inserted into the ferrule in juxtaposition with the shaft tip end tenon. The tip insert has a head provided with a transverse cue tip pad supporting surface, said head having a lower surface adapted to contact an upper end of the ferrule so as to completely transfer cue ball impact forces from the tip insert directly into the ferrule. The ferrule is so constructed and arranged with respect to the tip insert that the juxtaposed end of the tip insert tenon and the shaft tip end tenon are spaced from one another a short distance whereby no cue ball impact forces can be transferred between them. The invention further contemplates the combination of a billiard cue having an improved shaft tip assembly comprising a billiard cue providing a shaft having a shaft tip end including an axial, elongated tenon, and the tip assembly described above.

DESCRIPTION OF THE PREFERRED EMBODIMENT

Figure 1:
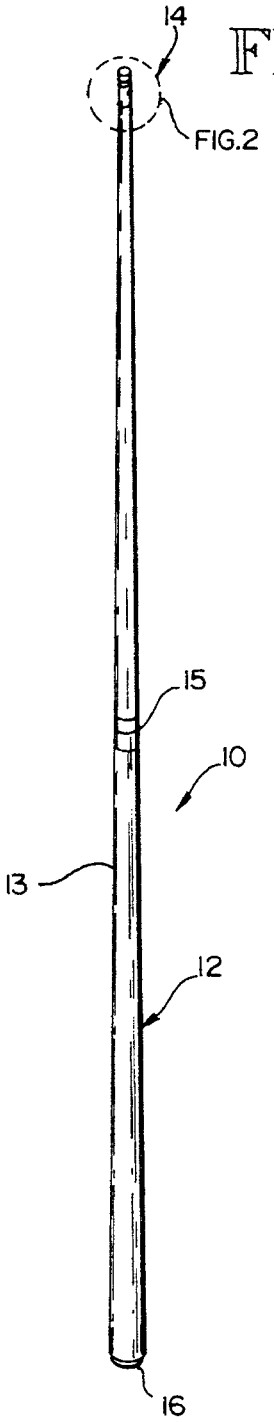
FIG. 1 illustrates a billiard cue fitted with the cue tip assembly of this invention.
Figure 2:
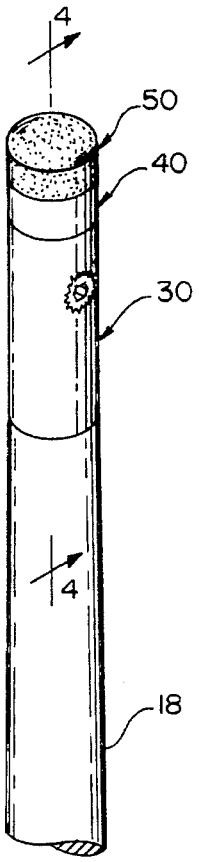
FIG. 2 illustrates an enlarged detail view of the cue tip assembly of this invention
Figure 3:
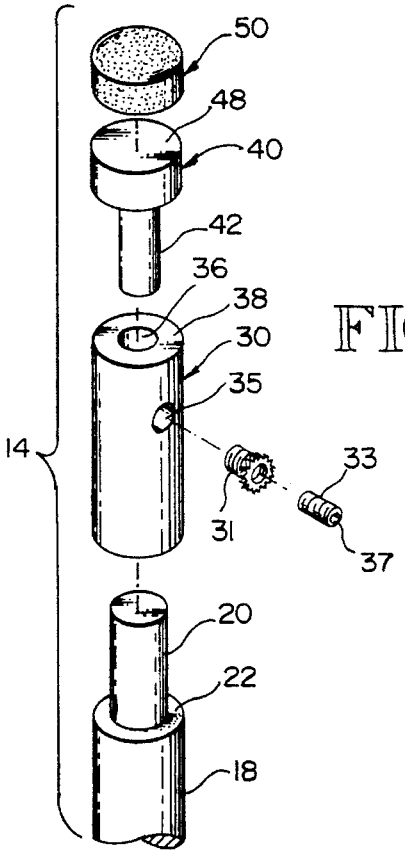
FIG. 3 illustrates, in an exploded view, the various elements that make up the cut tip assembly of this invention.
Figure 4:
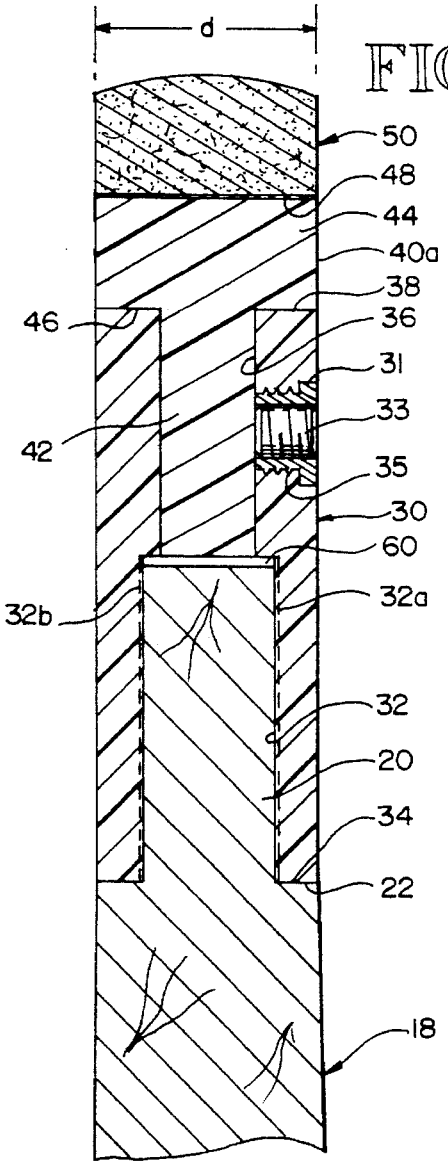
FIG. 4 is a vertical cross section taken along the line 4—4 of FIG. 2.
Figure 5:
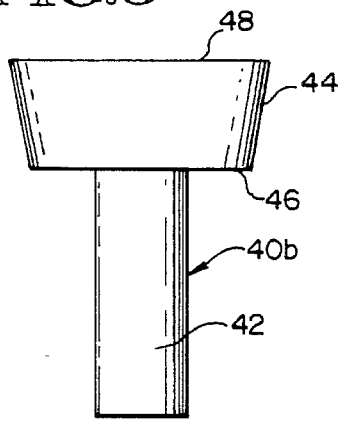
FIGS. 5–8 illustrates the variety of cue tip inserts that may be mounted in the cue tip assembly of this invention so as to accommodate a variety of cue tip pad diameters on a single billiard cue.
Figure 6:
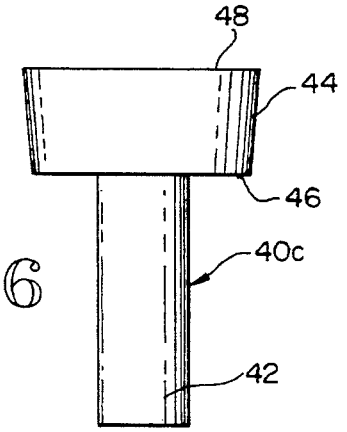
Figure 7:
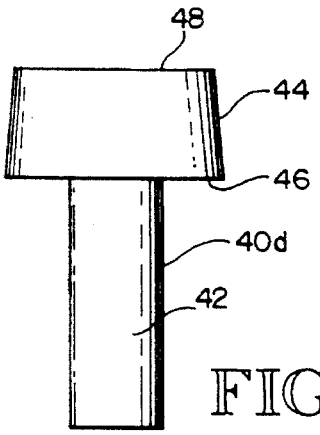
Figure 8:
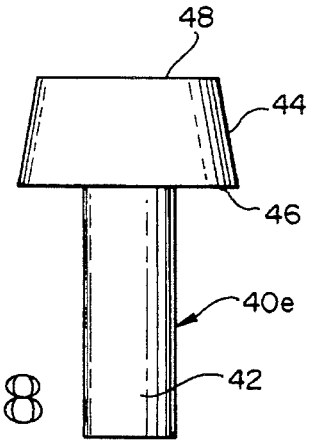

A billiard cue 10 comprises a handle section 12 and a cue tip section 14. The handle section 12 typically consists of an elongated, tapered shaft 13 having a circular cross-section and larger butt end 16 and a more or less uniform taper from the butt end to the tip section 14. The billiard cue shaft 13 may be jointed as at 15. Whereas, the typical billiard cue simply terminates at its tip end in a circular tip surface perpendicular to it longitudinal axis for receipt of a cue tip pad, the billiard cue of this invention terminates in a cue tip assembly that comprises tip section 14. Billiard cues are typically fabricated of wood and cue 10 is shown herein of wood construction. As seen in FIGS. 2–4, this cue tip assembly comprises a ferrule 30, a cue tip insert 40 (40*a* in FIG. 4) and a cue tip pad 50. The ferrule 30 and the tip 18 of the billiard cue are cooperatively constructed so that the ferrule 30 fits over and around the outer-most part 20 of the cue tip 18 and seats on an annular land 22 at the base of part 20; the annulus of land 22 being perpendicular to the longitudinal axis of shaft 13. Part 20 is provided as a cylindrical tenon formed from and integral with shaft 13. The cue tip insert 40 and the ferrule 30 are cooperatively constructed so that insert 40 can be releasably joined to ferrule 30. Cue tip insert 40 provides a transverse circular surface 42 for mounting the cue tip pad 50. In this combination of the cue tip assembly 14 and the billiard cue shaft 13, a variety of cue tip pads can be alternately attached to the same shaft 13 simply by substituting one insert 40 for another; FIGS. 5–8 illustrating four such inserts 40*b*–40*e* that could be substituted for the insert 40*a* shown in FIG. 4, each such insert, 40*a*–40*e*, being configured to mount a cue tip pad having a different diameter. Thus, for example, if the cue tip insert 40*a* shown in FIG. 4 had a cue tip pad-receiving surface diameter "d" of 10 mm., the corresponding diameter of FIG. 5's insert might be 15 mm, FIG. 6's might be 12 mm, FIG. 7's might be 9 mm and FIG. 8's might be 7 mm.

Ferrule 30 is preferably plastic, molded of DELRIN, but it may be fabricated of NYLON or of a metal such as brass.

Ferrule 30 comprises a body that has a first, longitudinal, cylindrical passage 32 for receipt of tenon 20 of tip 18. The lower end 34 of the body is annular and sized to conform to and set on land 22. Passage 32 may be fluted, as at 32*a*, 32*b*, so as to provide longitudinal ribs or ridges, 1/32nd or 1/64th inch high, to bite into the side of tenon 20 to help secure ferrule 30 against rotation relative to shaft 13. Alternately, passage 32 may be threaded, with matching threads being provided on tenon 20; or ferrule 30 may be pinned to tenon 20 by means of a pin (not shown) that would be extended through the side wall of ferrule 30 and through tenon 20. The diameter of passage 32 closely approximates the outer diameter of tenon 20 and the two, tenon 20 and passage 32, are adhered together by a suitable glue, such as DELRIN glue, WELD-ON #810 adhesive, or a clear household glue such as GOOP. The body of ferrule 30 is further provided with a second, longitudinal, cylindrical passage 36 for receipt of a cylindrical tenon 42 of tip insert 40 (40*a* in FIG. 4). The outer, upper end 38 of the body is annular and provides a flat surface perpendicular to the longitudinal axis of the ferrule. The exterior surface of the ferrule body is preferably tapered on the order of 1/4° to 1/2° from mid-ferrule to the lower end 22, the degree of taper being selected to match commonly-found shaft ends 22. Depending on the cue shaft diameter, a taper may or may not be required.

Tip insert 40 (40*a* in FIG. 4, and 40*a–e* in FIGS. 5–8), in addition to tenon 42, comprises a tip head 44 of circular cross-section of larger diameter than tenon 42 providing an inner annular surface 46 transverse to tenon 42 for supporting contact with end 38 of the ferrule body, end 38 serving as a support shoulder for tip insert 40. Annular surface 46 is sized to conform to the outer diameter of end 38. Head 44 provides a circular cue tip pad mounting surface 48 perpendicular to the longitudinal axis of tenon 42. The diameter of mounting surface 48 will be sized to match the size of the cue tip pad 50 which was be attached thereto, such 7 mm, 8 mm, 9 mm, 10 mm, 11 mm, 12 mm, 13 mm, 14 mm or 15 mm which are the typical diameters of conventional cue tip pads. The outer side of head 44 will be tapered if necessary (as shown in FIGS. 5–8) to transition from the circumference of surface 48 to the outer circumference of surface 46. The outer diameter of tip insert tenon 42 closely fits within the upper passage 36 of the ferrule body; a close tolerance on the order of 0.0003–0.0005 inches being preferred. A precision fit is important to maintain the stability of the connection between the tip insert 40 and ferrule 30.

Ferrule 30 is further provided with a tip insert fastener in the form of a threaded insert 31 fitted with a threaded set screw 33. Insert 31 is force-fitted within a transverse passage 35 provided therefor through the ferrule body that open to the upper passage 36. The outer end of set screw 33 is provided with a recessed tool-engaging slot 37 so that screw 33 can be threaded into and out of locking engagement with the outer periphery to tip insert tenon 42. When screw 33 is engaged with tenon 42, the tip insert 40 is secured within ferrule 30. To remove and replace one tip insert with another, an appropriate tool can be inserted into slot 37 and screw 33 unthreaded to release the tip insert. Set screw 33 serves to keep the tip insert 40 from rotating when a cue ball is struck. Tip insert 40 is preferably fabricated of plastic, such as molded ABS plastic, but it may be fabricated of DELRIN. PVC plastic, or of a metal such as aluminum or brass.

When a tip insert is secured within the ferrule upper passage 36, the tip insert head 44 seats against upper ferrule end 38 for its entire support against the shock of striking a cue ball. Consequently, the force of impact is transferred from tip insert 40 directly to the ferrule body and, from the ferrule body, directly to the land 22 at the end of the cue shaft 13. In order to insure that no impact force is transmitted to the cue shaft tenon 20, ferrule 30 is constructed and arranged with respect to the length of tip insert tenon 42 and cue shaft tenon 20 that a small air gap 60 is provided between the adjacent ends of the two tenons as shown in FIG. 4. Air gap 60 serves to insulate the two tenons from one another so that no impact force will be transmitted to the shaft tenon 20.

A suitable cue tip 50, typically leather, is secured to the outer surface 48 of the tip insert with a suitable glue or adhesive such as TWEETEN'S 10 MINUTE CEMENT.

The tip insert tenon 42 will have a typical diameter of about 3/16 inches. The shaft tenon 20 will have a diameter of about 1/4–5/16 inches.

While the preferred embodiment of the invention has been described herein, variations in the design may be made. The scope of the invention, therefore, is only to be limited by the claims appended hereto.

The embodiments of the invention in which an exclusive property is claimed are defined as follows:

1. A billiard cue shaft tip assembly for attachment to a shaft that has a tip end provided with an elongated axial tenon, the tip assembly comprising a ferrule adapted to be secured to the shaft tip end tenon; and a plurality of different size tip inserts, each having an elongated axial tenon adapted to be releasably inserted into said ferrule in juxtaposition with said shaft tip end tenon, each said tip insert further having a head provided with a transverse cue tip pad supporting surface, said head having a lower surface adapted to contact an upper end of said ferrule so as to completely transfer cue ball impact forces from said tip insert directly into said ferrule, said ferrule being so constructed and arranged with respect to said tip inserts that the juxtaposed end of said tip insert tenon and said shaft tip end tenon are spaced from one another a short distance whereby no cue ball impact forces can be transferred between them; each said tip insert having a head providing a cue tip pad supporting surface of a different size for receiving a different sized cue tip pad whereby said tip assembly can provide a variety of cue tip pads for quick and convenient selection and mounting to a single billiard cue by means of said ferrule being secured to said shaft tip end tenon.

2. The tip assembly according to claim 1 wherein said ferrule is fabricated from a synthetic material selected from the group comprising DELRIN plastic and nylon, and wherein each of said tip inserts is fabricated from a synthetic material selected from the group comprising ABS plastic, PVC plastic, and aluminum.

3. The tip assembly according to claim 2 wherein said ferrule is provided with an internal axial passage for receipt of said shaft tip end tenon, said ferrule passage being fluted with axial, longitudinal ridges or ribs for engaging said shaft tip end tenon to secure said ferrule against rotation relative to said shaft tip end tenon.

4. A billiard cue comprising a shaft having a shaft tip end including an axial, elongated tenon; and a tip assembly comprising a ferrule adapted to be secured to the shaft tip end tenon, and a plurality of different size tip inserts, each having an elongated axial tenon adapted to be releasably inserted into said ferrule in juxtaposition with said shaft tip end tenon, each said tip insert further having a head provided with a transverse cue tip pad supporting surface, said head having a lower surface adapted to contact an upper end of said ferrule so as to completely transfer cue ball impact forces from said tip insert directly into said ferrule, said ferrule being so constructed and arranged with respect to said tip inserts that the juxtaposed end of said tip insert tenon and said shaft tip end tenon are spaced from one another a short distance whereby no cue ball impact forces can be transferred between them; each said tip insert having a head providing a cue tip pad supporting surface of a different size for receiving a different sized cue tip pad whereby said tip assembly can provide a variety of cue tip pads of varying hardness and diameter for quick and convenient selection and mounting to a single billiard cue by means of said ferrule being secured to said shaft tip end tenon.

5. The tip assembly according to claim 4 wherein said ferrule is fabricated from a synthetic material selected from the group comprising DELRIN plastic and nylon, and wherein each of said tip inserts is fabricated from a synthetic material selected from the group comprising ABS plastic, PVC plastic, and aluminum in a range of diameters and a range of hardness.

6. The tip assembly according to claim 4 wherein said ferrule is provided with an internal axial passage for receipt of said shaft tip end tenon, said ferrule passage being fluted with axial, longitudinal ridges or ribs for engaging said shaft tip end tenon to secure said ferrule against rotation relative to said shaft tip end tenon.

* * * * *